US009658025B2

(12) United States Patent
Trpkovski

(10) Patent No.: US 9,658,025 B2
(45) Date of Patent: May 23, 2017

(54) BULLPUP CROSSBOW

(71) Applicant: MCP IP, LLC, Sparta, WI (US)

(72) Inventor: Paul Trpkovski, Green Cove Springs, FL (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 14/704,619

(22) Filed: May 5, 2015

(65) Prior Publication Data

US 2015/0233665 A1 Aug. 20, 2015

Related U.S. Application Data

(63) Continuation of application No. 13/480,774, filed on May 25, 2012, now Pat. No. 9,022,013.

(60) Provisional application No. 61/489,727, filed on May 25, 2011.

(51) Int. Cl.

| | |
|---|---|
| ***F41B 5/12*** | (2006.01) |
| ***F41B 5/18*** | (2006.01) |
| ***F41B 5/14*** | (2006.01) |

(52) U.S. Cl.

CPC ..... *F41B 5/12* (2013.01); *F41B 5/1469* (2013.01)

(58) Field of Classification Search

CPC ..... F41B 5/12; F41B 5/123; F41B 5/1469
USPC ..... 124/25, 86, 87, 90
See application file for complete search history.

(56) References Cited

U.S. PATENT DOCUMENTS

| | | | | |
|---|---|---|---|---|
| 2,500,509 | A * | 3/1950 | Bailey | F41B 5/12 124/25 |
| 4,722,318 | A * | 2/1988 | Yankey | F41B 5/143 124/25 |
| 5,243,956 | A * | 9/1993 | Luehring | F41B 5/12 124/25 |
| 7,281,534 | B2 * | 10/2007 | Bednar | F41B 5/10 124/25 |
| 7,624,725 | B1 * | 12/2009 | Choma | F41B 5/1469 124/25 |
| 7,823,572 | B2 * | 11/2010 | Anderson | F41B 5/123 124/25 |
| 7,832,386 | B2 * | 11/2010 | Bednar | F41B 5/105 124/25 |
| 7,836,871 | B2 * | 11/2010 | Kempf | F41B 5/123 124/25 |
| 7,891,348 | B2 * | 2/2011 | Colley | F41B 5/105 124/25 |
| 7,930,849 | B2 * | 4/2011 | Abraham | F41C 23/14 42/73 |
| 8,375,928 | B1 * | 2/2013 | Bednar | F41B 5/1469 124/25 |
| 8,439,024 | B2 * | 5/2013 | Barnett | F41B 5/1469 124/25 |
| 8,443,790 | B2 * | 5/2013 | Pestrue | F41B 5/12 124/25 |
| 8,567,376 | B2 * | 10/2013 | Flint | F41B 5/12 124/20.3 |

(Continued)

*Primary Examiner* — Alexander Niconovich

(57) ABSTRACT

In some embodiments, a crossbow comprises a stock and a bow portion comprising at least one limb and a string. A riser attaches said bow portion to the stock. A latch is located in proximity to a butt of the stock. The latch is configured to retain the string in a drawn condition. A trigger is arranged to release the latch. An extension member extends from the butt of the stock to the latch. The extension member and the stock define a cavity, and the latch assembly is oriented within the cavity.

19 Claims, 11 Drawing Sheets

(56) References Cited

U.S. PATENT DOCUMENTS

| | | | | |
|---|---|---|---|---|
| 8,573,192 | B2 * | 11/2013 | Bednar | F41B 5/1469 124/25 |
| 8,651,094 | B2 * | 2/2014 | Matasic | F41B 5/12 124/23.1 |
| 8,689,774 | B1 * | 4/2014 | Ritz | F41B 5/1469 124/25 |
| 8,701,641 | B2 * | 4/2014 | Biafore, Jr. | F41B 5/123 124/25 |
| 8,701,642 | B2 * | 4/2014 | Biafore, Jr. | F41B 5/123 124/25 |
| 8,800,540 | B1 * | 8/2014 | Choma | F41B 5/12 124/25 |
| 2006/0086346 | A1 * | 4/2006 | Middleton | F41B 5/12 124/25 |
| 2009/0101126 | A1 * | 4/2009 | Anderson | F41B 5/123 124/25 |
| 2010/0000504 | A1 * | 1/2010 | Trpkovski | F41B 5/0094 124/25.6 |
| 2011/0016764 | A1 * | 1/2011 | Cales | F41C 23/14 42/90 |
| 2011/0168151 | A1 * | 7/2011 | Kingsbury | F41G 11/003 124/89 |
| 2011/0303205 | A1 * | 12/2011 | Goff | F41B 5/12 124/31 |
| 2012/0298087 | A1 * | 11/2012 | Trpkovski | F41B 5/10 124/25 |
| 2014/0069403 | A1 * | 3/2014 | Simonds | F41B 5/123 124/25 |
| 2014/0069404 | A1 * | 3/2014 | McPherson | F41B 5/123 124/25 |
| 2015/0013654 | A1 * | 1/2015 | Bednar | F41B 5/1469 124/25 |

* cited by examiner

BULLPUP CROSSBOW

CROSS-REFERENCE TO RELATED APPLICATIONS

This application is a continuation application of U.S. patent application Ser. No. 13/480,774, filed May 25, 2012, which claims the benefit of U.S. Patent Application No. 61/489,727, filed May 25, 2011, the entire disclosure of which is hereby incorporated herein by reference.

BACKGROUND OF THE INVENTION

This invention relates generally to bows and crossbows, and more particularly to compact crossbows having a relatively long power stroke.

Crossbows are generally known in the art. Crossbows typically include a bow portion mounted on a stock, as well as a string latch and release mechanism.

A crossbow string can be drawn and held in a drawn condition by the string latch. The distance traversed between the at-rest position of the string and the drawn position is known as the draw length or power stroke. Crossbows having a longer power stroke traditionally have also had a longer overall length.

There remains a need for novel crossbow designs that provide benefits over the prior art. There remains a need for shorter crossbows that have a longer power stroke.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a crossbow comprises a stock and a bow portion comprising at least one limb and a string. A riser attaches said bow portion to the stock. A latch is located in proximity to a butt of the stock. The latch is configured to retain the string in a drawn condition. A trigger is arranged to release the latch. An extension member extends from the butt of the stock to the latch. The extension member and the stock define a cavity, and the latch assembly is oriented within the cavity.

In some embodiments, a crossbow comprises a stock and a bow portion comprising at least one limb and a string. A riser attaches said bow portion to the stock. A latch is located in proximity to a butt of the stock. The latch is configured to retain the string in a drawn condition. A trigger is arranged to release the latch. The butt of the stock comprises a rope guide located at a rear end of the butt. In some embodiments, the rope guide comprises a groove that is aligned with a height of the latch.

In some embodiments, a crossbow comprises a stock and a bow portion comprising at least one limb and a string. A riser attaches said bow portion to the stock. A latch is located in proximity to a butt of the stock. The latch is configured to retain the string in a drawn condition. A trigger is arranged to release the latch. The crossbow defines a sight mounting location. The latch is centered in a lateral direction of the crossbow, and a center of the sight mounting location is offset laterally from the latch.

In some embodiments, a crossbow comprises a string latch positioned substantially below a cheek rest or extension member of the buttstock. In some embodiments, the string latch is partially surrounded by the buttstock and cheek rest.

In some embodiments, a crossbow comprises a compound bow portion having at least one continuous limb that extends continuously between rotatable members of the compound bow portion. In some embodiments, the bow portion comprises a pair of continuous limbs, and the crossbow is arranged to shoot an arrow between the limbs.

In some embodiments, a crossbow comprises a rope cocking guide located at a rear end of the buttstock. In some embodiments, a rope cocking guide comprises a groove that extends into the buttstock.

In some embodiments, a crossbow comprises a centered string latch and a scope rail that is offset left or right from a central axis of a barrel. In some embodiments, a portion of the buttstock is offset left or right from a central axis of the barrel. In some embodiments, a cheek rest is offset left or right from a central axis of a barrel.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
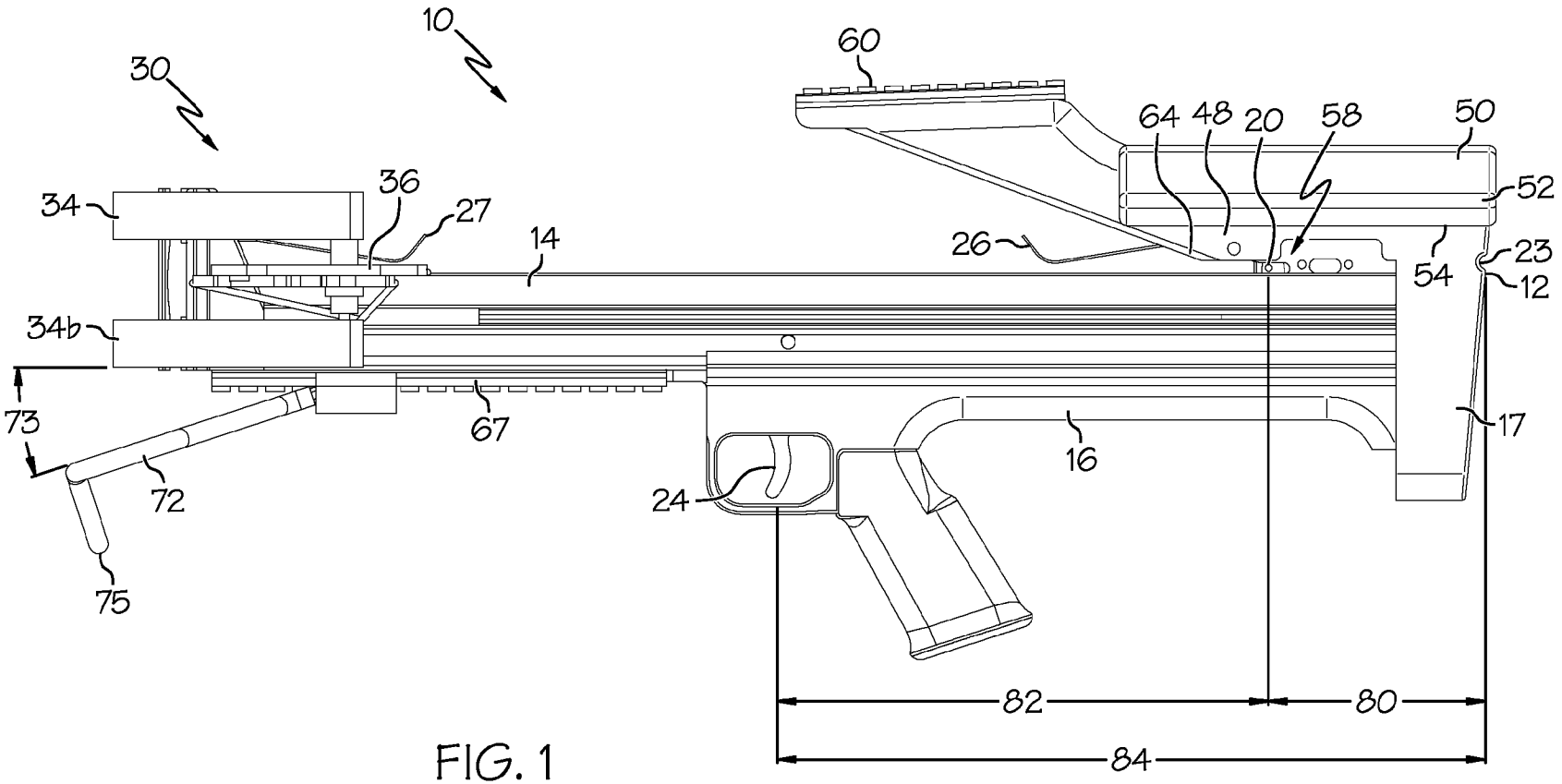
FIG. 1 shows a side view of an embodiment of a crossbow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 5:
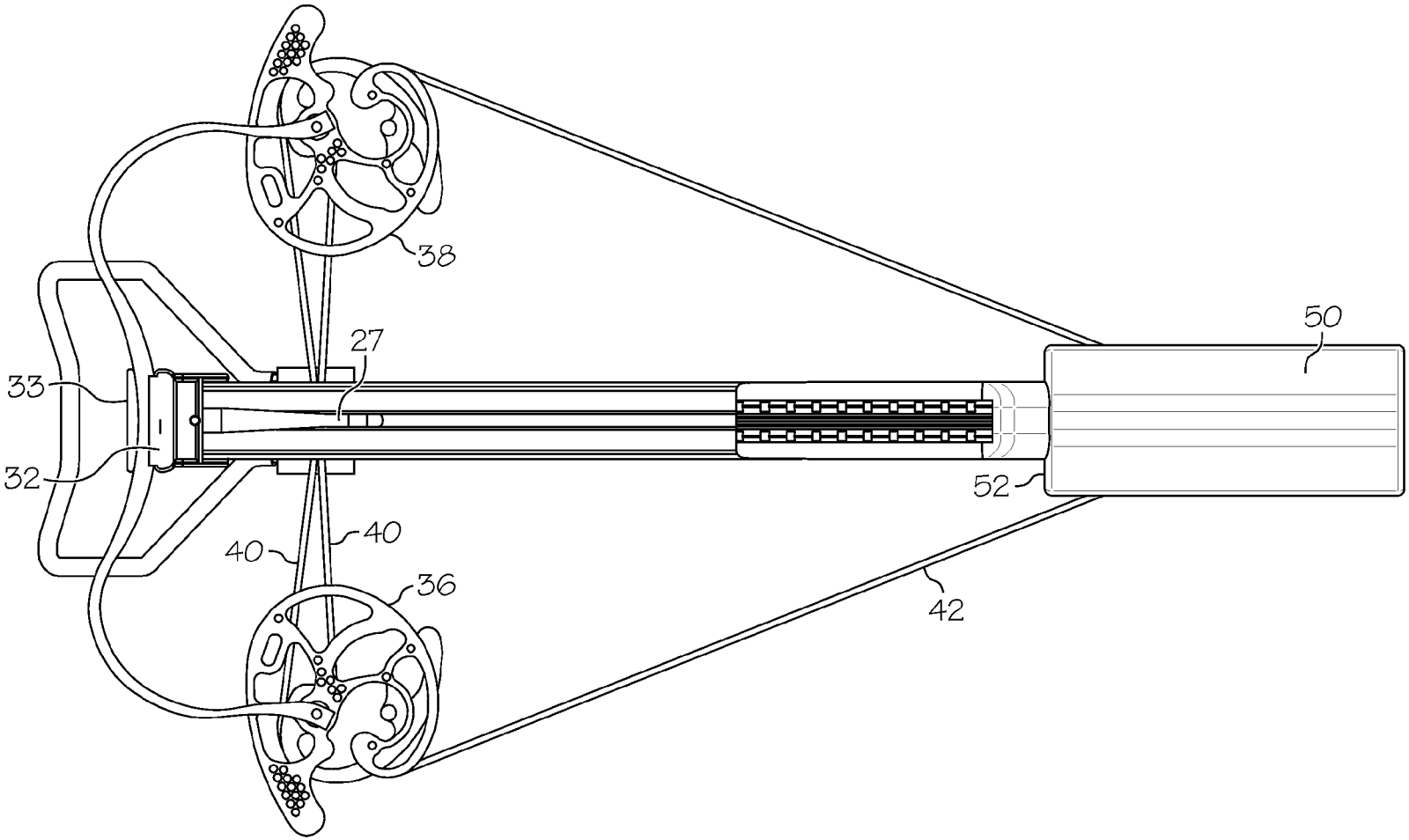
FIG. 5 shows a top view of an embodiment of a crossbow in a drawn condition.
Figure 6:
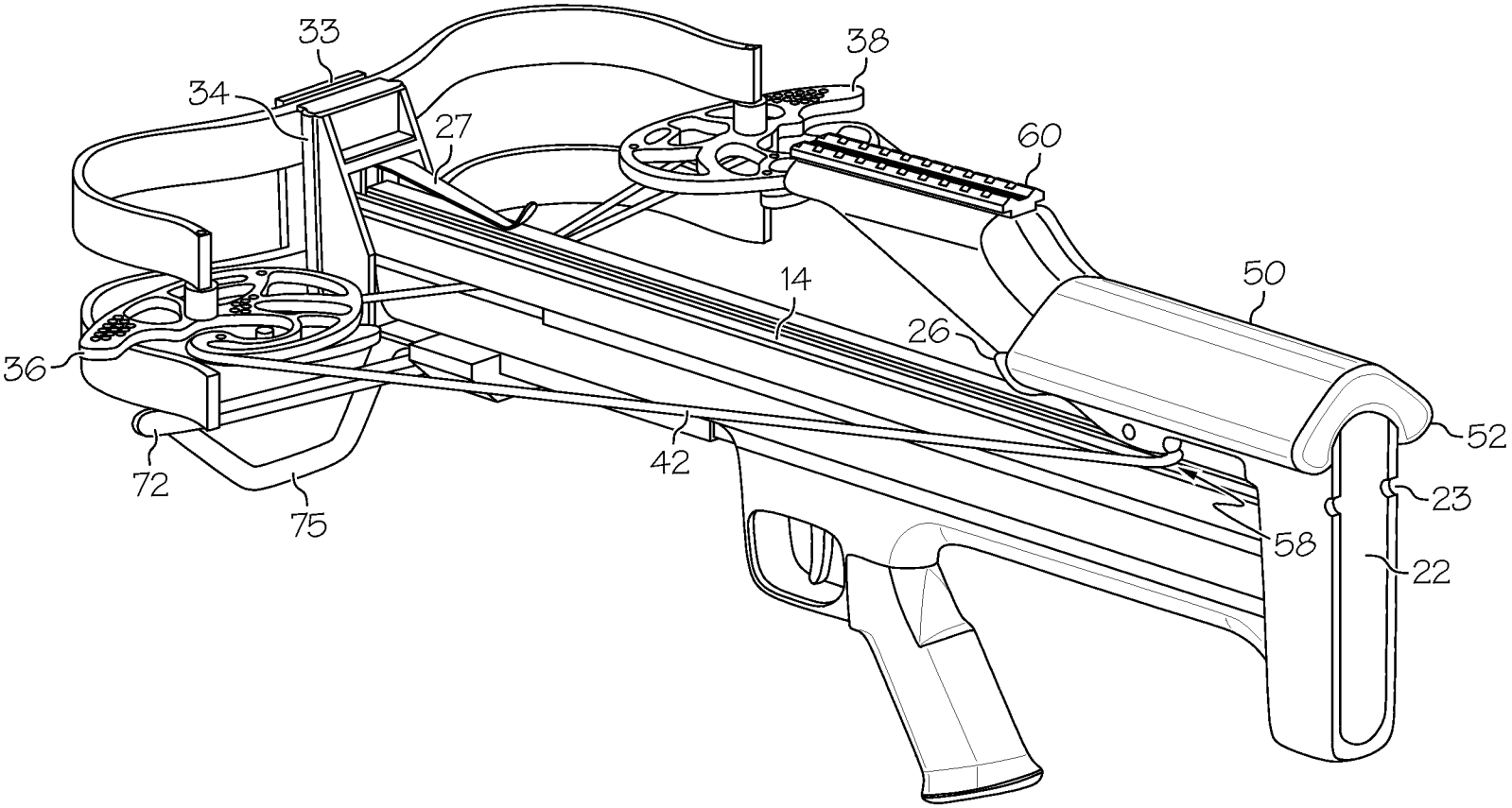
FIG. 6 shows a rear quarter perspective view of an embodiment of a crossbow.

With reference to FIGS. 1-4, an embodiment of a crossbow 10 is shown comprising a bow portion 30, a barrel 14, a stock 16, a latch 20 and a trigger 24. The bow portion 30 desirably comprises at least one limb 34 and a string 42. The string 42 is generally pulled back using applied force, which stores energy in the bow portion 30 (e.g. the limb 34), and the string is retained in a cocked position by the latch 20 (FIGS. 5 and 6 show a crossbow 10 in a cocked orientation). A release mechanism such as the trigger 24 will release the string 42 from the latch 20, which will allow the crossbow 10 to fire an arrow or bolt.

An end of the stock 16 comprises a butt 17, which is typically placed in contact with the shooter to brace the crossbow 10 during a shot. Desirably, the string latch 20 is located close to the butt 17 of the stock 16. Locating the latch 20 close to the butt 17 helps to maximize power stroke. Desirably, the latch 20 is located 6" or less from a rear end 12 of the crossbow 10. In some embodiments, the latch 20 is located 4" or less from the rear end 12. Desirably, a distance between the latch 20 and the rear end 12 is less than a distance between the latch 20 and the trigger 24. Desirably, a distance between the latch 20 and the rear end 12, as measured in a direction parallel to a central axis of the barrel 14 (e.g. distance 80 in FIG. 1), is less than a distance between the latch 20 and the trigger 24 as measured in a direction parallel to a central axis of the barrel 14 (e.g. distance 82 in FIG. 1). In some embodiments, the latch 20 is located in the first half of a distance from the butt 17 to the trigger 24 as measured in a direction parallel to a central axis of the barrel 14 (e.g. distance 80 in FIG. 1 can be half of distance 84 or less). In some embodiments, the latch 20 is located in the first third of a distance from the butt 17 to the trigger 24 as measured in a direction parallel to a central axis of the barrel 14 (e.g. distance 80 in FIG. 1 can be one-third of distance 84 or less).

The trigger 24 communicates with the latch 20 via a trigger mechanism (not shown). Trigger mechanisms are generally known in the art. For example, U.S. Pat. No. 5,884,614 to Darlington and U.S. Pat. No. 4,693,228 to Simonds each disclose suitable trigger mechanisms, and are hereby incorporated herein by reference in their entireties.

Desirably, the trigger 24 is located 5" to 12" forward of the latch 20 (e.g. distance 82 in FIG. 1 desirably ranges from 5" to 12"). In some embodiments, the trigger 24 is located 8" to 11" forward of the latch 20. In some embodiments, the trigger 24 is located 9" to 10" forward of the latch 20.

In some embodiments, the trigger 24 is located approximately 12" to 14" forward of the rear end 12 of the crossbow 10 (e.g. distance 84 in FIG. 1 can be 12" to 14"). In some embodiments, the trigger 24 is located approximately 13" forward of the rear end 12 of the crossbow 10.

Although specific distances have been described with respect to distances 80, 82, 84 in FIG. 1, the latch 20 and trigger 24 can have any suitable orientation with respect to one another, and each can have any suitable orientation with respect to the rear end 12 of the crossbow 10.

In some embodiments, the crossbow 10 comprises an extension member 48 that extends over the latch 20. The extension member 48 is desirably structurally attached to the stock 16. In some embodiments, the extension member 48 comprises an extension of the butt 17 or the stock 16. In some embodiments, at least a portion of the extension member 48 extends over a portion of the barrel 14. In some embodiments, at least a portion of the extension member 48 comprises a cantilever member that extends over a portion of the barrel 14. Desirably, the extension member 48 extends over the latch 20. In some embodiments, a portion of the extension member 48 oriented over the latch 20 comprises a cantilever. Desirably the extension member 48 comprises a mount for various accessories or other portions of the crossbow 10, such as a cheek rest 50, accessory mount 60, etc.

In some embodiments, the crossbow 10 comprises a cheek rest 50. A cheek rest 50 can be permanent or removable. In some embodiments, the cheek rest comprises a pad. In some embodiments, a cheek rest 50 is supported by the extension member 48. In some embodiments, the cheek rest 50 is a unitary portion of the extension member 48.

Desirably, at least a portion of the cheek rest 50 is oriented above the latch 20 (e.g. directly above the latch 20). Desirably, a cheek rest 50 is oriented with respect to the butt 17 such that a shooter's cheek can easily rest against the cheek rest 50 when the crossbow 10 is held with the butt 17 braced against the shooter's body (e.g. shoulder). In some embodiments, the cheek rest 50 extends rearward to the rear end 12 of the crossbow 10. In some embodiments, the cheek rest 50 extends forward of the latch 20.

In some embodiments, the latch 20 is at least partially surrounded by the cheek rest 50, butt 17 and stock 16 portions of the crossbow 10. In some embodiments, the latch 20 is at least partially surrounded by the cheek rest 50, butt 17 and a portion of the barrel 14 (e.g. rear portion). In some embodiments, the latch 20 is at least partially surrounded by the extension member 48, butt 17 and stock 16 portions of the crossbow 10. In some embodiments, the latch 20 is at least partially surrounded by the extension member 48, butt 17 and a portion of the barrel 14 (e.g. rear portion). In some embodiments, the stock 16 and extension member 48 define a cavity 58. In some embodiments, a rear portion of the barrel 14 and the extension member 48 define a cavity 58. In some embodiments, the latch 20 is located in the cavity 58.

In some embodiments, a lowest portion of the extension member 48 oriented above or in front of the latch 20 is located at a height above the latch 20. For example, the cavity 58 can extend forward of the latch 20. This helps to ensure that the extension member 48 will not interfere with the string 42.

In some embodiments, the extension member 48 comprises a front guide portion 64 that can help guide the string 42 toward the latch 20 during draw, should the string 42 contact the extension member 48. In some embodiments, the front guide portion 64 comprises a straight edge that extends nonparallel to an axis of the barrel 14. In some embodiments, a front guide portion 64 can include curvature.

In some embodiments, a cheek rest 50 comprises an overhanging portion 52 that overhangs a portion of the barrel 14 and/or a portion of the stock 16. In some embodiments, the cheek rest 50 is wider than the stock 16. An overhanging portion 52 can be located on either side of the crossbow 10. An overhanging portion 52 located on the left side of the crossbow 10 will be suitable for a right-handed shooter, and vice versa. In some embodiments, a cheek rest 50 comprises an overhanging portion 52 on both the right and left sides, allowing use by both right-handed and left-handed shooters. In some embodiments, the cheek rest 50 is symmetrical across a vertical plane that passes through the barrel 14 axis.

FIG. 5 shows a top view of an embodiment of a crossbow 10 in a cocked orientation. This view illustrates how an overhanging portion 52 of the cheek rest 50 can act as a barrier between a shooter's face and the string 42, thereby helping to prevent the string 42 from contacting the shooter's face inadvertently. The overhanging portion 52 can also help to prevent the string 42 from contacting long facial hair of the shooter.

The cheek rest 50 is desirably located at least one inch above the latch 20. In some embodiments, the cheek rest 50 is located anywhere from one-half inch above the latch 20 to more than 3" above the latch 20. In some embodiments, the cheek rest 50 is located approximately 2" above the latch 20.

The cheek rest 50 can have any suitable length. In some embodiments, the cheek rest 50 has a length of 6" to 8".

In some embodiments, a lowest portion of the cheek rest 50 is located at a height above the latch 20. For example, the lowest portion of an overhanging portion 52 is located at a height above the height of the latch 20. This provides clearance for the string 42 and archer during cocking, and prevents the cheek rest 50 from interfering with a cocking operation. FIG. 6 shows a rear perspective view where the clearance can be seen.

In some embodiments, a rear arrow retention spring 26 is located in proximity to the latch 20. In some embodiments, at least a portion of the rear arrow retention spring 26 is located under a cheek rest 50. In some embodiments, the rear arrow retention spring 26 is supported by structure that supports the cheek rest 50, for example being supported by the extension member 48.

In some embodiments, the extension member 48 defines an accessory mounting location 60. In some embodiments, the extension member comprises an accessory mount 61 configured to receive standardized accessories, such as a Picatinny rail or tactical rail. Any suitable accessory, such as sights, optics, lights, etc., can be mounted at the accessory mounting location 60. Desirably, the accessory mounting location 60 is oriented forward of a cheek rest 50 and at a height above the cheek rest 50, which allows for sights/scopes to be properly placed at eye level when a shooter's face contacts the cheek rest 50.

Figure 2:
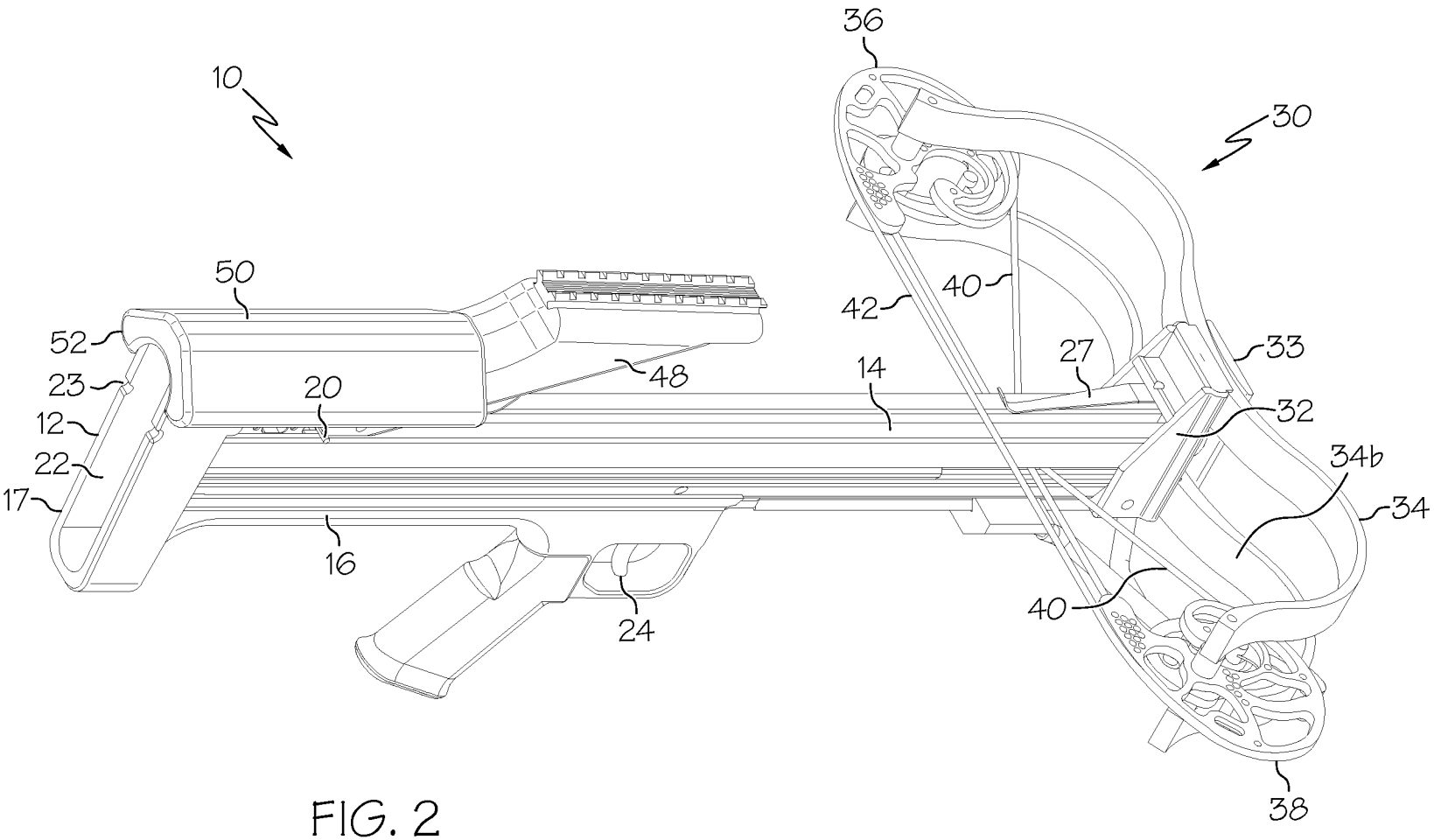
FIG. 2 shows a rear upper perspective view of an embodiment of a crossbow.

In some embodiments, the butt 17 or rear stock 16 defines an aperture 22 that extends through the butt 17 in a direction parallel to the axis of the barrel 14 (See e.g. FIGS. 2 and 6). Desirably, at least a portion of the aperture 22 is aligned with the latch 20 in a longitudinal direction of the crossbow 10. In some embodiments, the butt 17 comprises a U-shaped member that defines a large aperture 22.

In some embodiments, the butt 17 comprises a continuous rear surface.

In some embodiments, the butt 17 defines at least one rope guide 23. In some embodiments, a rope guide 23 comprises at least one groove in the buttstock 17. Desirably, the groove is of a sufficient depth and shape to securely retain a cocking rope. In some embodiments, a rope guide 23 extends into the rear end 12 of the crossbow 10. Desirably, the rope guides 23 are located at a height that is aligned with the latch 20 in a longitudinal direction of the crossbow 10 (e.g. aligned with an arrow shooting plane). The rope guides 23 will help to hold a cocking rope in proper alignment with the latch 20 during a string 42 drawing operation. In some embodiments, a rope guide 23 is located in a middle portion of the height of the rear end 12 of the butt 17. In some embodiments, a rope guide 23 is substantially centered midway up the height of the rear end 12 of the butt 17. In some embodiments, a rope guide 23 is located between the midpoint and upper quarter of the height of the rear end 12 of the butt 17.

The bow portion 30 can comprise any suitable bow arrangement, for example comprising a recurve bow portion, a compound bow portion, etc. A compound bow portion will be more complicated, but will provide for reduced string 42 hold-back force, thus reducing loads on the latch 20 and wear on the string 42. A compound bow portion can comprise any suitable type of compound bow arrangement, such as single cam, two-cam, 1.5/hybrid/CPS cam, etc. A compound bow portion can further comprise a dual-sync arrangement as disclosed in U.S. Pat. No. 6,990,970, or a force vectoring anchor arrangement as disclosed in U.S. Pat. No. 8,020,544. The entire disclosures of U.S. Pat. No. 6,990,970, U.S. Pat. No. 8,020,544 and US 2010/0000504 are hereby incorporated herein by reference.

A compound bow portion typically includes a first rotatable member 36 and a second rotatable member 38. At least one of said rotatable members 36, 38 comprises a cam. In some embodiments, one of said rotatable members 36, 38 can be a pulley, for example in the case of a single cam bow. In some embodiments, each of said rotatable members 36, 38 comprises a cam. In some embodiments, the rotatable members 36, 38 are geometrically similar in shape. In some embodiments, a second rotatable member 38 comprises a mirror image of a first rotatable member 36.

FIGS. 1-6 show a bow portion 30 that comprises a dual-cam compound bow. As such, each rotatable member 36, 38 comprises a cam, and the bow portion 30 comprises two power cables 40, wherein each power cable 40 is taken up by a cam as the string 42 is drawn. The string 42 desirably extends from the first rotatable member 36 to the second rotatable member 38.

Figure 3:
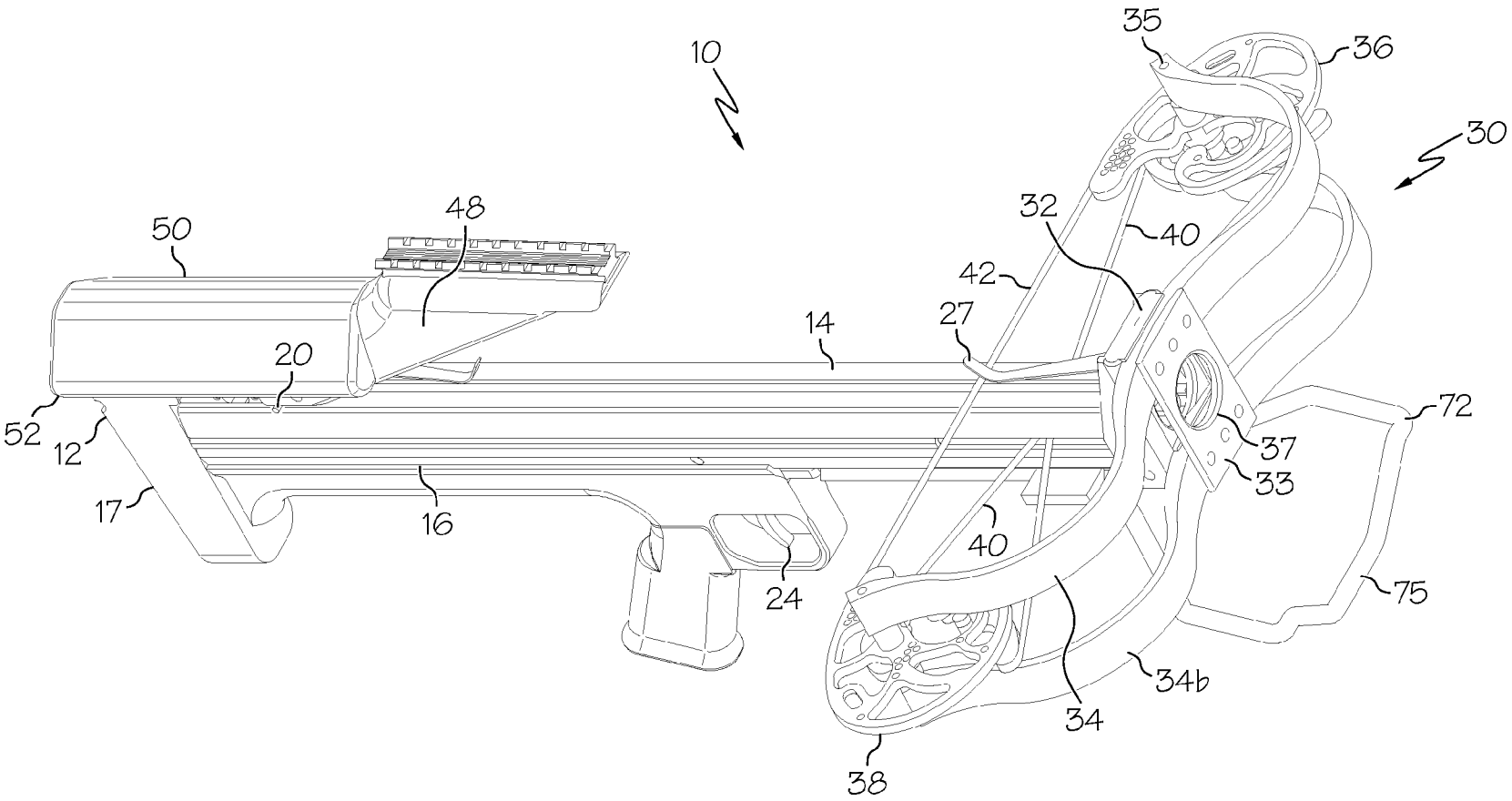
FIG. 3 shows a front upper perspective view of an embodiment of a crossbow.
Figure 4:
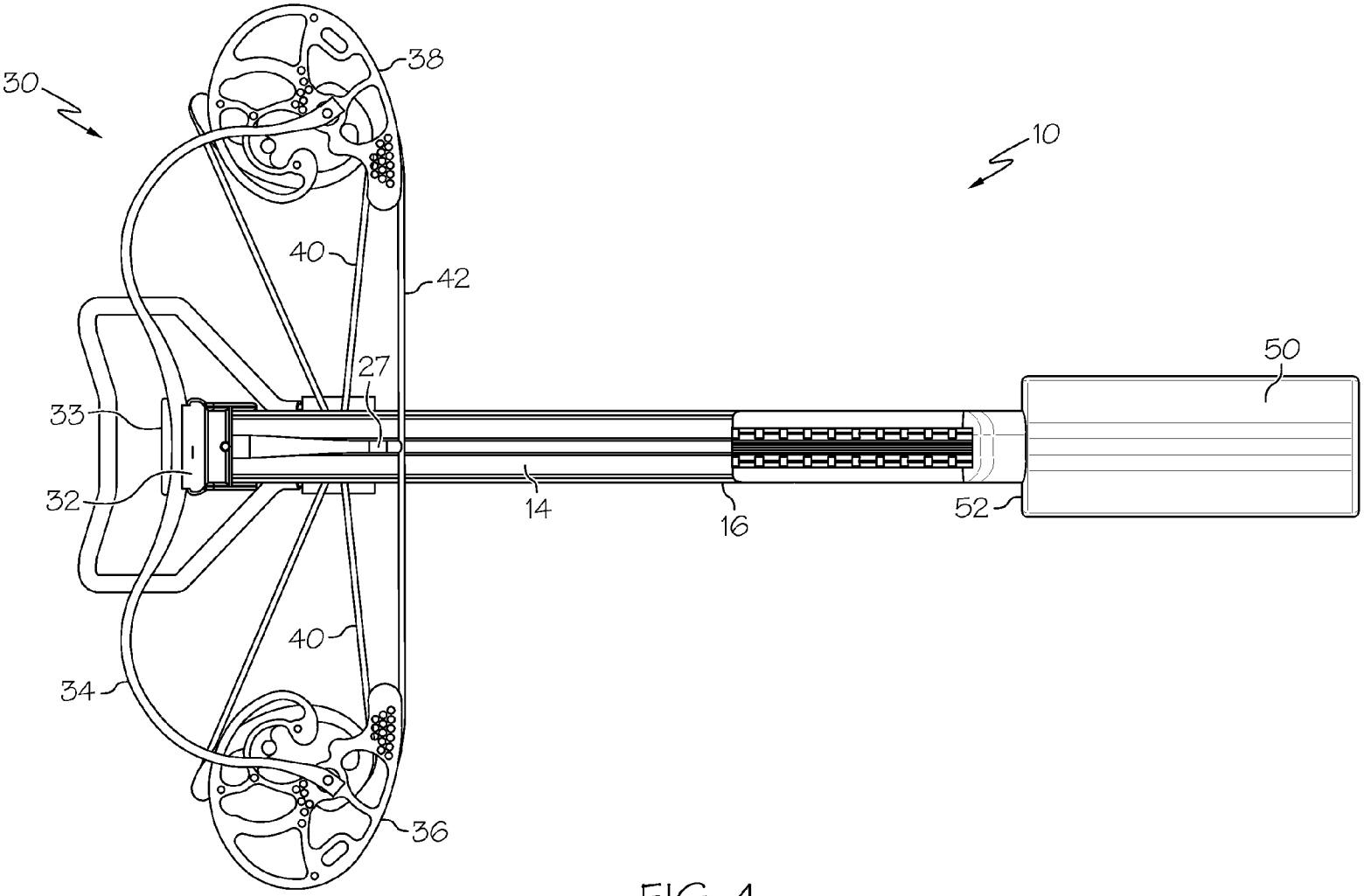
FIG. 4 shows a top view of an embodiment of a crossbow in an undrawn condition.

With reference to FIGS. 2 and 3, desirably the crossbow 10 comprises a riser 32 that attaches the limb(s) 34 to the crossbow 10, for example attaching to a front portion of the stock 16, to the barrel 14, or another suitable portion of the crossbow 10. In some embodiments, the riser 32 is attached to the crossbow 10 by a rigid moment connection. In some embodiments, the riser 32 is attached to a limb 34 by a rigid moment connection.

In some embodiments, a bow portion 30 comprises at least one limb 34 that extends continuously from the first rotatable member 36 to the second rotatable member 38. In some embodiments, the bow portion 30 comprises a second limb **34*b* that extends continuously between the rotatable members 36, 38. In some embodiments, a first continuous limb 34 is identical to a second continuous limb 34*b***.

In some embodiments, the rotatable members 36, 38 are oriented between a first continuous limb 34 and a second continuous limb **34*b*. For example, in some embodiments, an axle 35 can extend between the first limb 34 and second limb 34*b*, and the rotatable member 36 can be supported on the axle 35 between the limbs 34, 34*b***.

In some embodiments, the crossbow 10 is arranged such that the arrow passes between a first continuous limb 34 and a second continuous limb **34*b*. Desirably, the limbs 34, 34*b* are spaced to allow an arrow to freely pass between the limbs 34, 34*b* without contact. In some embodiments, the riser 32 comprises an aperture for an arrow or bolt to pass through when the crossbow 10** is fired.

When the bow portion 30 comprises continuous limb 34 spanning between the rotatable members 36, 38, a moment transferring connection is not required between the riser 32 and limb 34, but can be used if desired. Thus, in some embodiments, a continuous limb 34 can be attached to the crossbow 10 (e.g. to the riser 32) via a single fastener, such as a bolt. As shown in FIGS. 2 and 3, the limbs 34 are sandwiched between the riser 32 and a plate 33. A plate 33 can help to distribute loads and can be visually appealing. In some embodiments, a separate plate could be used on each limb 34, 34*b*. In some embodiments, a single plate 33 can be used. In some embodiments, a plate 33 comprises an aperture 37 for an arrow or bolt to pass through when the crossbow 10 is fired.

In some embodiments, a continuous limb 34 can be concave (for example being concave with respect to the latch 20). As shown in the Figures (e.g FIGS. 2 and 3), a continuous limb 34 can include both concave and convex portions, and can include one or more inflection points.

In some embodiments, the crossbow 10 comprises a front arrow retention spring 27, which is desirably located to help retain an arrow in/on the barrel 14. In some embodiments, a front arrow retention spring 27 is aligned longitudinally with the rotatable members 36, 38 and power cable(s) 40. The front arrow retention spring 27 can attach to any suitable portion of the crossbow 10. In some embodiments, the front arrow retention spring 27 is attached to the riser 32.

Desirably, the barrel 14 defines a central axis that is centered in the crossbow 10. Desirably, the latch 20 is also centered. In some embodiments, the crossbow 10 comprises a cheek rest 50 that extends to the left or right beyond the stock 16 or rear portion of the barrel 14. The extended cheek rest 50 helps to position the shooter's face farther away from the string 42 during a shot.

In some embodiments, the accessory mounting location 60 can be offset to the left or right of the barrel 14 axis. In some embodiments, at least a portion of the extension member 48 is offset to the left or right of the barrel 14 axis. In some embodiments, the entire butt 17, extension member 48 and accessory mounting location 60 can be offset to the left or right of the barrel 14 axis. These embodiments can have any suitable amount of lateral offset. In some embodiments, the offset ranges from 0.5" to 2" or more (e.g. a centerline of 60, 48 and/or 17 can be offset this far from a center of the crossbow 10).

Figure 7:
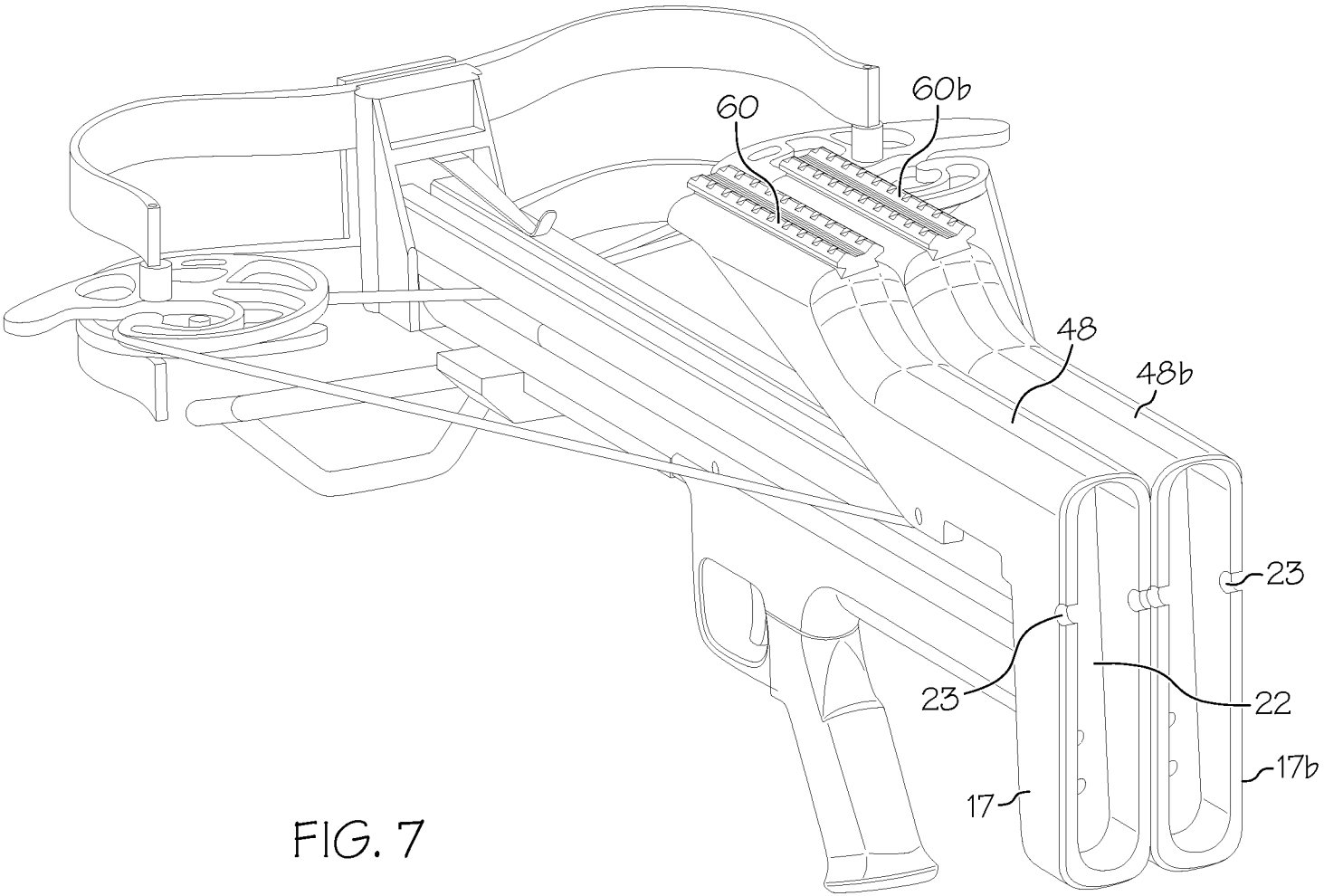
FIG. 7 shows a rear quarter perspective view of another embodiment of a crossbow.

FIG. 7 shows an embodiment of a crossbow 10 having a first buttstock 17, first extension member 48 and first accessory location 60 offset to the left of center of the crossbow. FIG. 7 further shows a second buttstock 17*b*, second extension member 48*b* and second accessory location 60*b* offset to the right of center of the crossbow. The crossbow 10 shown in FIG. 7 would be suitable for shooting by both left-handed and right-handed shooters. It should be noted that a crossbow 10 intended only for a right-handed shooter could omit the second buttstock 17*b*, second extension member 48*b* and second accessory location 60*b*, and vice versa. In some other embodiments, a buttstock 17 and extension member 48 can be made the collective size of both the first and second buttstocks 17, 17*b* and the first and second extension members 48, 48*b* shown in FIG. 7, and can have a single aperture 22.

Figure 8:
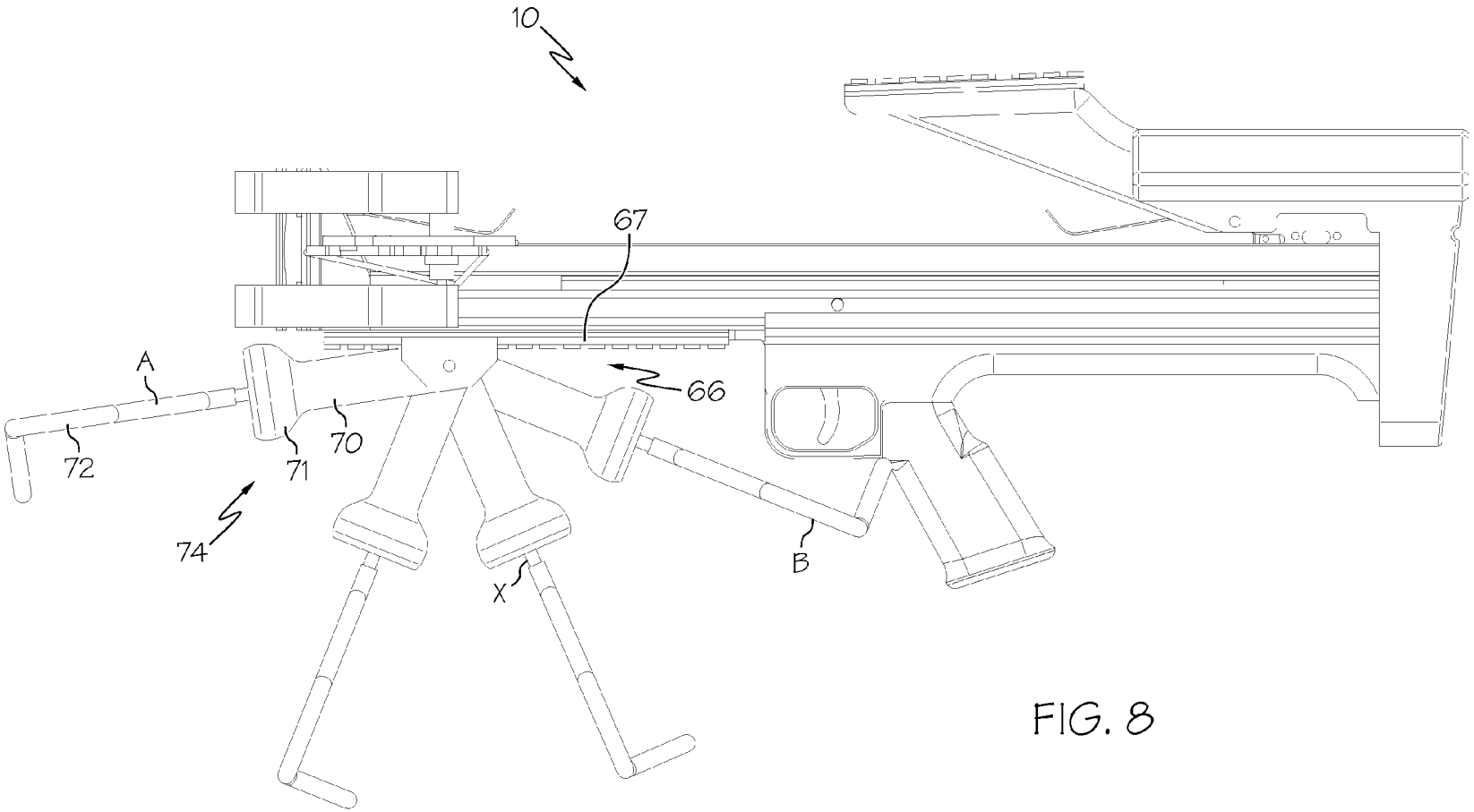
FIG. 8 shows a side view of another embodiment of a crossbow.

Referring to FIG. 8, in some embodiments, a crossbow 10 comprises a front accessory mounting location 66. In some embodiments, a front accessory mounting location 66 comprises a front accessory mount 67 configured to receive standardized accessories, such as a Picatinny rail or tactical rail. Any suitable accessory, such as lights, grips, quivers, etc., can be mounted at the front accessory mounting location 66.

In some embodiments, a crossbow 10 comprises a front grip 70. In some embodiments, a crossbow 10 comprises a foot stirrup 72. In some embodiments, a stirrup can extend as a slightly downward angle 73 (see FIG. 1). A stirrup 72 can further include an offset portion that extends farther downward from the rest of the stirrup 72 (see e.g. FIGS. 3 and 6).

In some embodiments, a crossbow 10 comprises a front accessory 74 that comprises both a shaped grip 70 and a foot stirrup 72. In some embodiments, the shaped grip 70 comprises a lower flange 71 to help locate a shooter's hand as they grasp the grip 70, and prevent downward migration of the hand. Desirably, the front accessory 74 is arranged to rotate such that the grip 70 can be oriented to extend downward for grasping during a shot. The accessory 74 can be moved such that the stirrup 72 will be properly oriented for a cocking operation (see position A in FIG. 8). In some embodiments, the accessory 74 can also be folded into a reduced size/storage configuration (see position B in FIG. 8). In some embodiments, the accessory 74 can further include a hinge (not shown), for example at location X shown in FIG. 8, which can allow for a more compact storage position.

Figure 9:
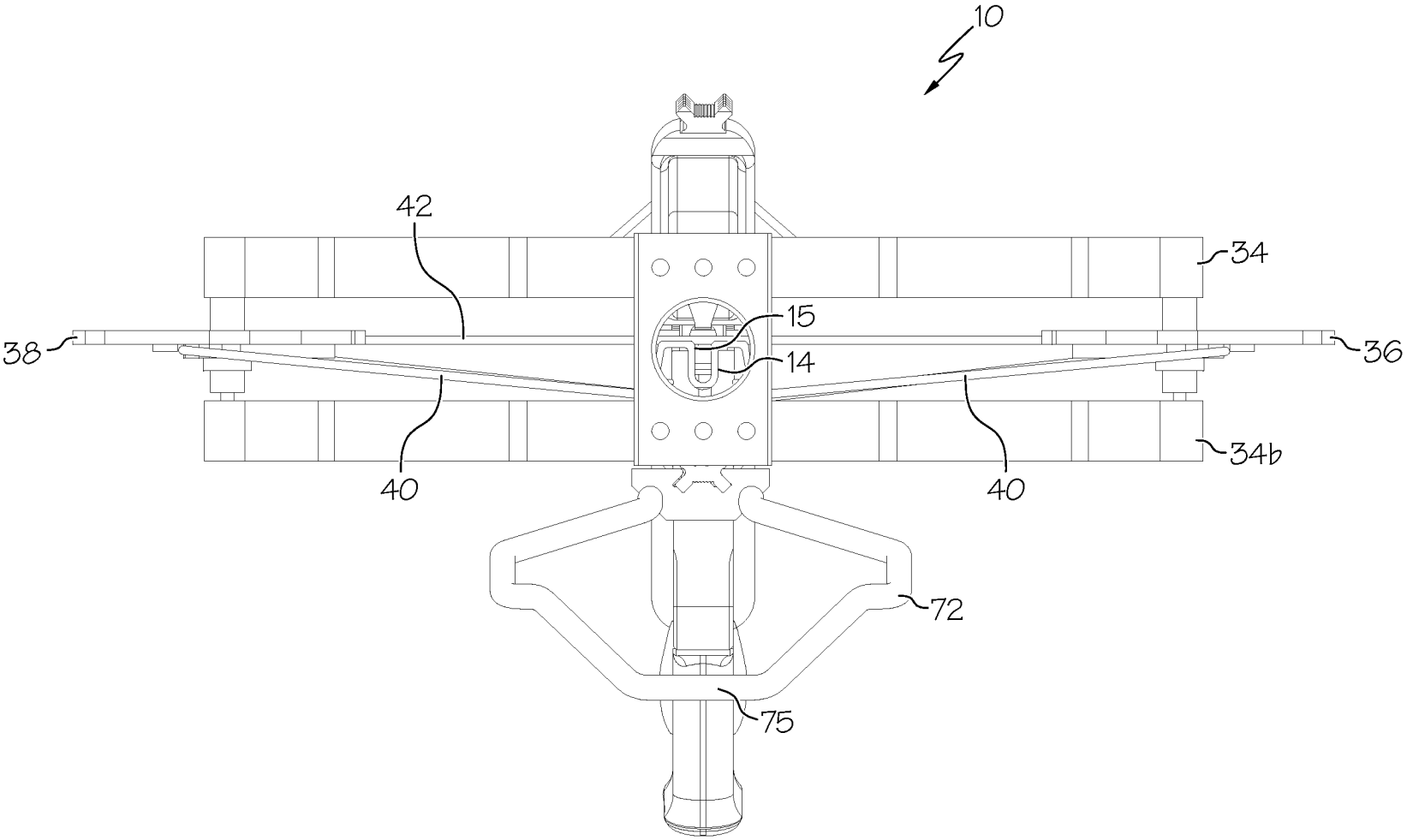
FIG. 9 shows a front view of an embodiment of a crossbow.

FIG. 9 shows a front view of an embodiment of a crossbow 10. This view best illustrates a groove 15 that desirably extends down a length of the barrel 14. Desirably, the groove 15 is sized such that an arrow or bolt is properly located when placed upon the barrel 14. Desirably, the groove 15 provides clearance for fletching or other stabilizers of an arrow or bolt.

Figure 10:
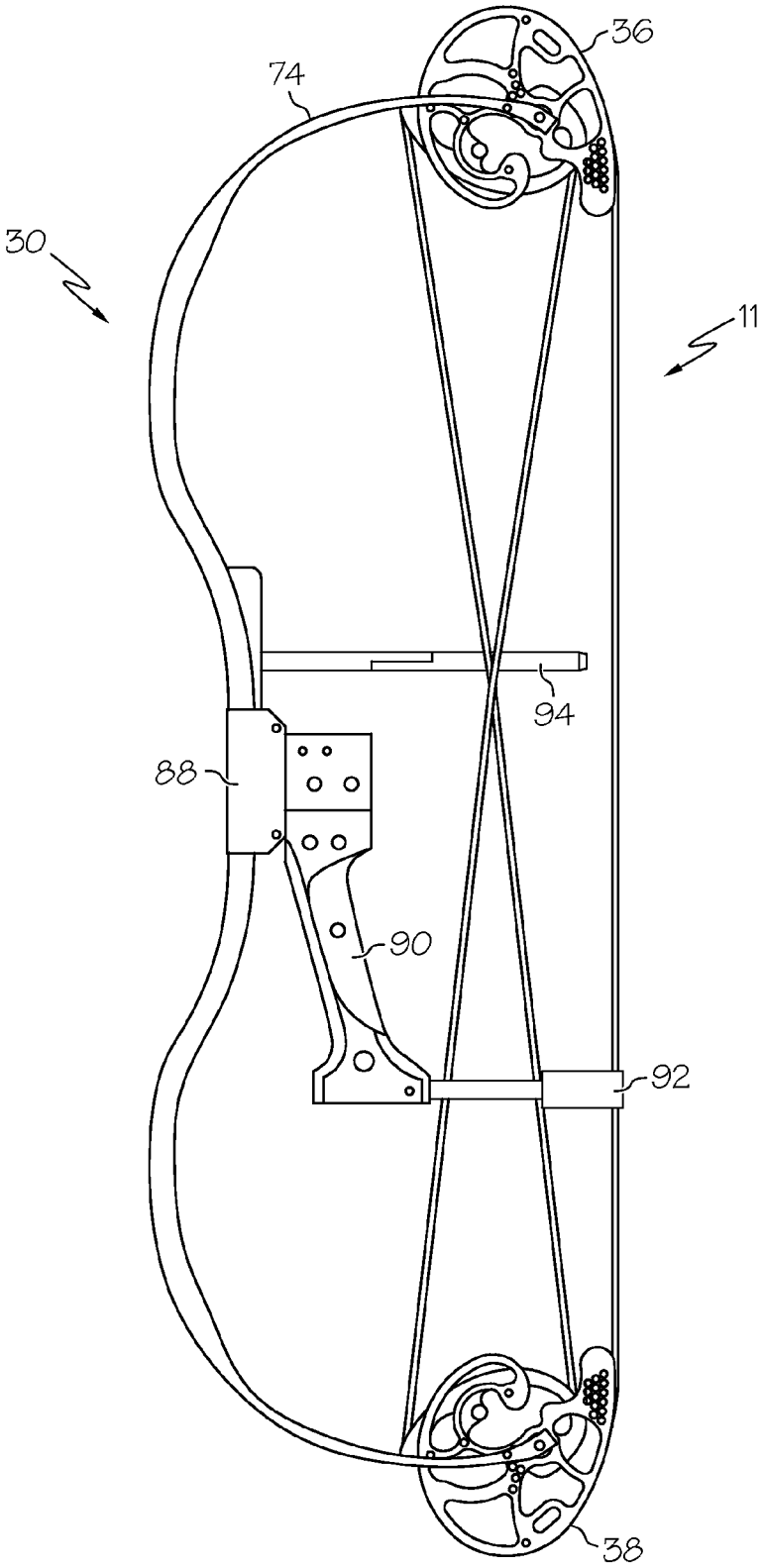
FIG. 10 shows a side view of an embodiment of an archery bow.
Figure 11:
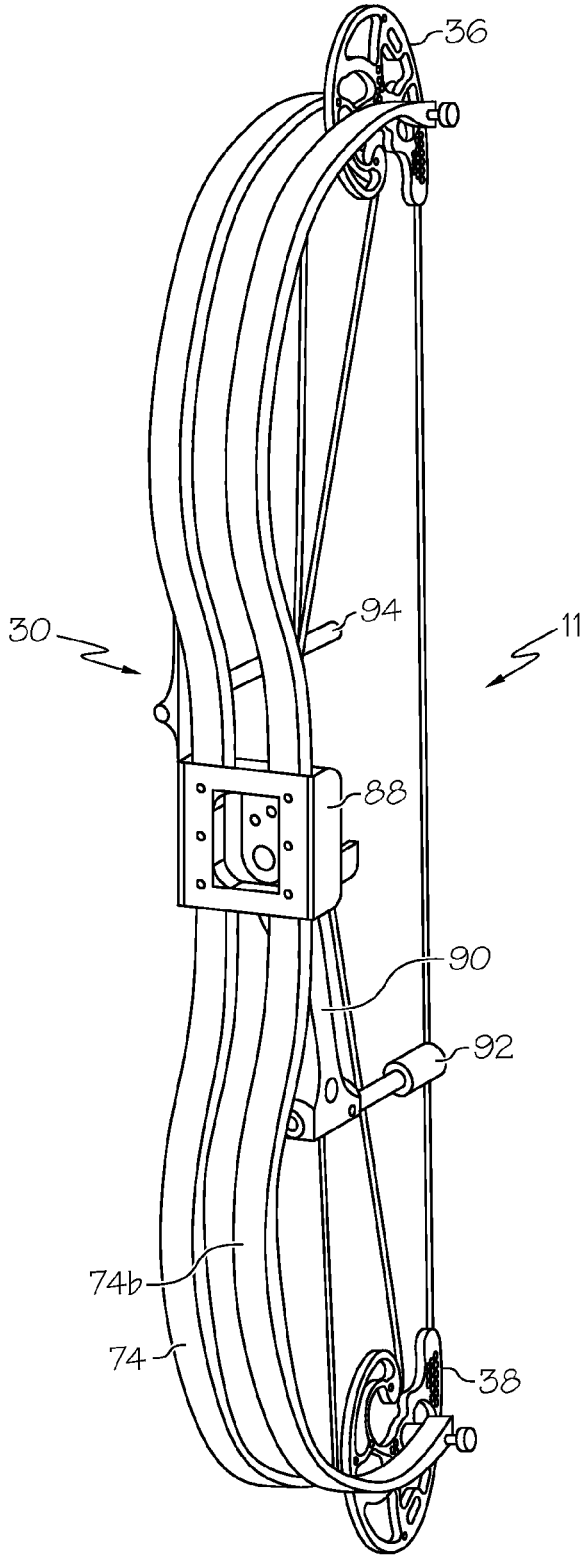
FIG. 11 shows a perspective view of an embodiment of an archery bow.

Although this disclosure has focused on crossbow 10 embodiments, the bow portion 30 described herein can also be used on traditional archery bows. FIGS. 10 and 11 show an embodiment of a bow portion 30 configured for use as an archery bow 11. An archery bow 11 can comprise a riser 88 that includes a grip 90. In some embodiments, the riser 88 can also support a string stop 92. In some embodiments, the riser 88 can also support a cable guard 94. The archery bow 11 is configured such that arrows pass between the limbs 34, 34*b* and an aperture in the riser 88.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A crossbow comprising:

a stock comprising a butt, said stock defining a shooting axis, a rear end of said butt comprising a rope guide recess, said rope guide recess comprising a groove formed in said rear end;

a bow portion comprising at least one limb and a string;

a riser attaching said bow portion to said stock;

a latch located in proximity to said butt, the latch configured to retain said string in a drawn condition;

a trigger arranged to release said latch, said trigger positioned below the shooting axis;

wherein said rope guide recess is positioned below the shooting axis.

2. The crossbow of claim 1, comprising an extension member comprising a cantilever extending over said latch, said cantilever supported by said stock.

3. The crossbow of claim 2, wherein said extension member comprises a cheek rest, at least a portion of said cheek rest oriented over said latch.

4. The crossbow of claim 3, wherein said cheek rest comprises a laterally extending portion that overhangs said stock.

5. The crossbow of claim 4, wherein said laterally extending portion comprises a first laterally extending portion that overhangs said stock on a first side, and the cheek rest further comprises a second laterally extending portion that overhangs said stock on a second side.

6. The crossbow of claim 5, wherein said second laterally extending portion comprises a mirror image of said first laterally extending portion.

7. The crossbow of claim 3, wherein said cheek rest extends forward of said latch.

8. The crossbow of claim 3, wherein said extension member further comprises a sight mounting location located forward of said cheek rest and at a height above said cheek rest.

9. The crossbow of claim 2, wherein said extension member comprises a sight mounting location oriented above said stock and forward of said latch.

10. The crossbow of claim 9, wherein said latch is centered in a lateral direction of said crossbow, and a center of said sight mounting location is offset laterally from said latch.

11. The crossbow of claim 9, wherein said latch is centered in a lateral direction of said crossbow, and a center of said butt of said stock is offset laterally from said latch.

12. The crossbow of claim 2, comprising an arrow retention spring attached to said extension member.

13. The crossbow of claim 1, wherein said rope guide recess comprises a pair of grooves.

14. The crossbow of claim 1, wherein said latch is located in the first third of a distance from a rear end of said butt of said stock to said trigger.

15. The crossbow of claim 1, wherein said bow portion comprises a compound bow arrangement comprising a first rotatable member, a second rotatable member, at least one cam and at least one power cable.

16. The crossbow of claim 1, comprising a front accessory comprising a combined front grip and foot stirrup.

17. A crossbow comprising:

a stock having a butt, the stock defining a shooting axis;

a bow portion comprising at least one limb and a string;

a riser attaching said bow portion to said stock;

a latch configured to retain said string in a drawn condition;

a trigger arranged to release said latch, the trigger positioned below the shooting axis; and a rope guide recess, said rope guide recess comprising a groove formed in a rear end of said butt, said rope guide recess positioned below the shooting axis, said groove having a depth sufficient to securely retain a cocking rope.

18. The crossbow of claim 17, said rope guide recess located in a middle portion of a height of the rear end of the butt.

19. The crossbow of claim 17, said rope guide recess located between a midpoint and upper quarter of a height of the rear end of the butt.

* * * * *